United States Patent [19]

Rye

[11] Patent Number: 4,872,727

[45] Date of Patent: Oct. 10, 1989

[54] ADJUSTABLE ARMED CHAIR

[76] Inventor: Ralph K. Rye, 1559 College St. SE., Grand Rapids, Mich. 49507

[21] Appl. No.: 253,601

[22] Filed: Oct. 5, 1988

[51] Int. Cl.[4] ..... A47C 7/54

[52] U.S. Cl. ..... 297/411; 297/413; 297/417

[58] Field of Search ..... 297/417, 411, 113, 115, 297/116, 117, 411; 248/118.3, 118.5

[56] References Cited

U.S. PATENT DOCUMENTS

| | | | |
|---|---|---|---|
| 3,168,346 | 2/1965 | Rei | 297/113 |
| 4,085,967 | 4/1978 | Spencer | 297/115 |
| 4,307,913 | 12/1981 | Spiegelhoff | 297/417 |
| 4,311,338 | 1/1982 | Moorehouse | 297/417 |
| 4,496,190 | 1/1985 | Barley | 297/417 |
| 4,765,679 | 8/1988 | Lanuzzi et al. | 297/316 |

FOREIGN PATENT DOCUMENTS

| | | | |
|---|---|---|---|
| 2935946 | 3/1981 | Fed. Rep. of Germany | 297/417 |
| 0224818 | 12/1983 | Japan | 297/417 |
| 4018 | 2/1907 | United Kingdom | 297/113 |
| 746313 | 3/1956 | United Kingdom | 297/417 |

*Primary Examiner*—James T. McCall

*Attorney, Agent, or Firm*—Miller, Morriss & Pappas

[57] ABSTRACT

A new and useful adjustable chair and adjustable height chair arms therefor in which a parallelogram or pantographic mechanism for activation of the height adjustment of the chair arms is located in the back portion of the chair structure and the arms are pivotal on the back. A back support post pivotally supports the back. The support post, then, is extensibly secured to the seat support or frame and the seat is tiltably pivotal on a swivel bracket operating to turn on the vertical axis of a spindle post extending upwardly from the chair base. The seat has an adjustable resilient compression stabilizing spring support forward of the seat tilting pivot and forward of the swivel post axis. The back support is torsionally supported on its pivot connection to the frame in an adjustable manner. Cushion stop means function between the back and the back support post. The arms, flanking the seats carry the operational trigger for remotely actuating the infinite arm adjustment mechanism utilizing a locking source of stored energy and responding sensitively to the control of the user remotely actuating pantographic relationships moving both arms of the chair in selected planes generally parallel to a starting plane at a selected angle to the seat.

6 Claims, 4 Drawing Sheets

ADJUSTABLE ARMED CHAIR

The present invention is directed to a new chair and particularly is directed to a chair provided with height adjustable arms in which an infinite adjustment is achieved by the selection of the chair user to an elevation and angle coordinated with any selected use or postural positions within a range of extremes for normal usages.

The present invention also embraces a seat and seat back structure achieving an improved ergonometric objective and applicable with the height adjustment for arm height by pantographic means and controlled by a source of stored power controlled by the user in the seat.

BACKGROUND OF THE INVENTION

It is conventional to adjust the height of the seat of a chair and means are known in which the arms of chairs can be adjusted as to height by incremental or step wise movement. These devices require various manipulative steps such as by ratcheting that actually create substantial difficulty for the seated user. In general, the prior art is exemplified in the U.S. Letters Patent of Spencer 4,085,968, Rei 3,168,346, Spiegelhoff 4,307,913. None of such devices show or suggest remote control manipulation and by a source of stored power or energy built into elements of the chair and extending from the back of the chair.

In the device of Rei an arm for an automotive seat is stored in concealed position and then unfolds for arm rest usage.

In the device of Spencer a hemispheric rest ring is operably supported for the vertical pivot of a chair and requires manual clutch locking of the adjustments for lifting and tilting by someone other than the seated user.

In the device of Speigelhoff the mechanism for adjustment of the arms of a vehicle seat require step-wise manipultion of a ratchet and pawl structure and provides no infinite adjustment. The mechanism is embodied in the rest structure and is articulated with the chair base.

In addition, the seats of the chairs of the prior art reveiwed do not achieve the ergonometric advantages of the present invention.

The principal object of the present invention is to provide a chair with infinite height adjustment of the arms, in normal use ranges, and in which the control for the adjustment is achieved by the user occupying the seat.

Another object is to provide a pantographic mechanism that is powered by a stored source of energy remote from the actuating trigger and in which the control linkage is simple and the power is eccentrically applied. The power is directed into an element in the flanking arms which retain parallelity in all height positions. The arm rests can be selectively set at convenient tilt from horizontal reference.

Another object is to provide a seat and back structure useable with the height adjusted arms in providing optimum ergonometric adjustment to suit substantially all use environments for seating structures and adjusting to substantially all postural problems presented in commercial executive and professional work seating and in relaxation situations as well.

Other objects including simplicity, extended utility, economy of manufacture, and improved overall seating performance will be appreciated by those skilled in the art as the description proceeds.

IN THE DRAWINGS

Figure 1:
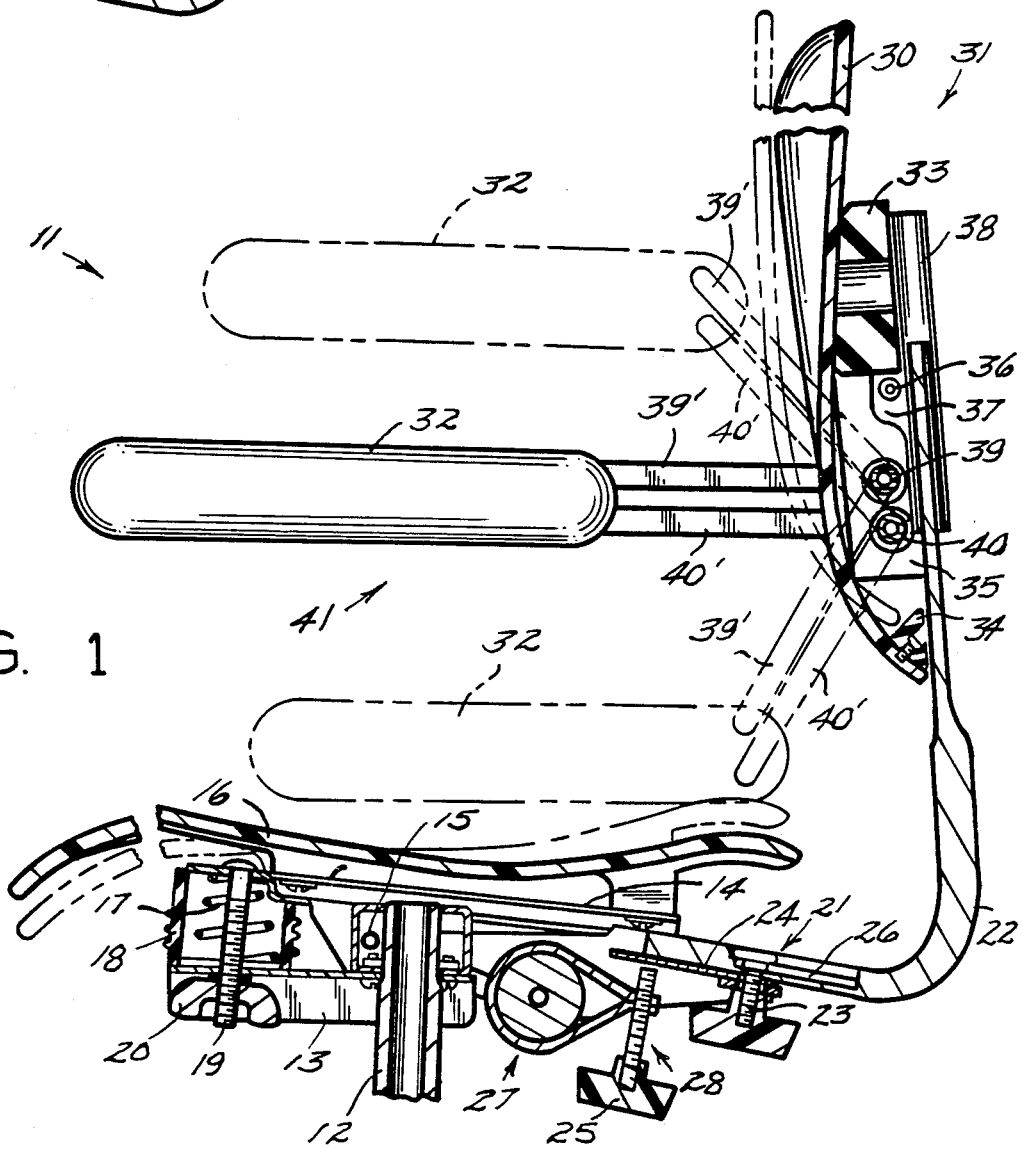
FIG. 1 is a full cross section profile view of a chair in accord with the present invention and taken through the back, back support, seat, and seat support, and indicating the adjustment range of seat and arms.
Figure 6:
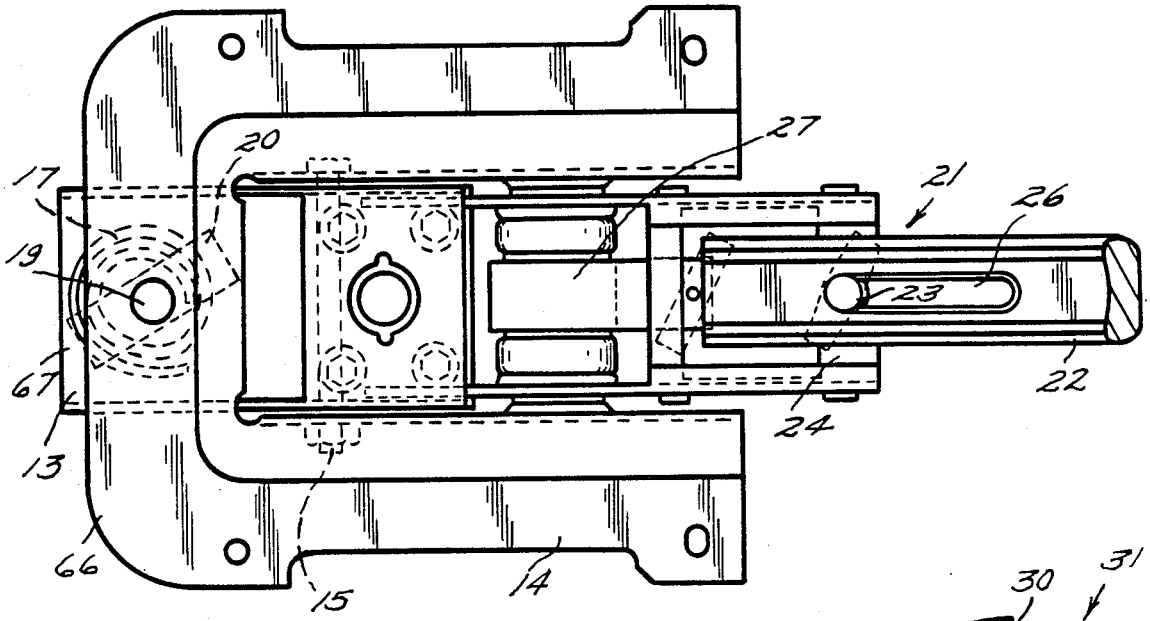

FIG. 6 is a top plan view of the seat base as shown in FIG. 1 and with the seat connective saddle element tiltable in respect to the vertical post or journal and adjustably supporting the back support element with torsion spring control over back support resilience and with adjustable tilt control acting between base and saddle, the tilt occuring on the horizontal pivot between chair base and saddle.

Figure 7:
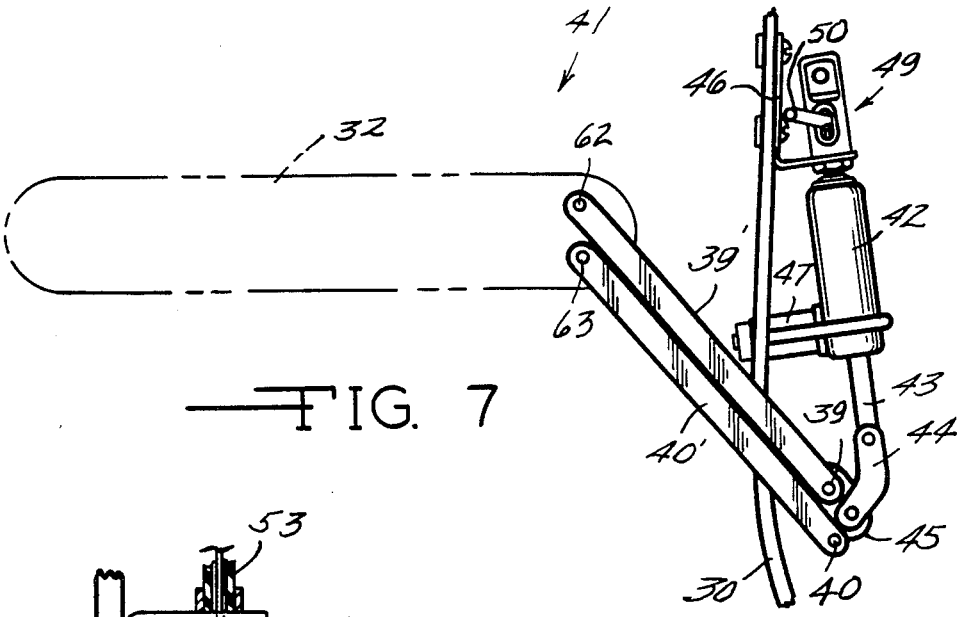

FIG. 7 is a side elevation view of a back plate in accord with the present invention in maximum upper support of the arms.

Figure 8:
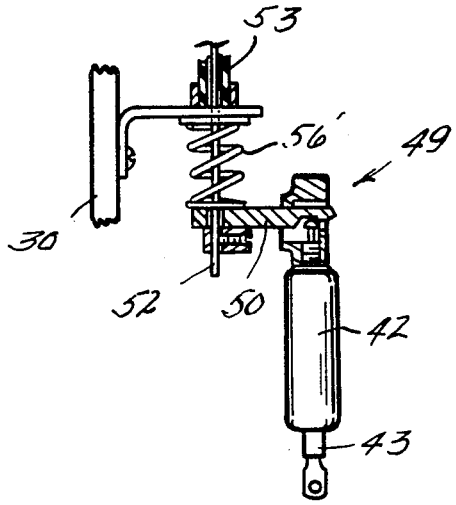

FIG. 8 is a cut-away partial elevation view of the control lever which is operated by a Bowden wire structure to lock and unlock the cylinder by remote control.

Figure 9:
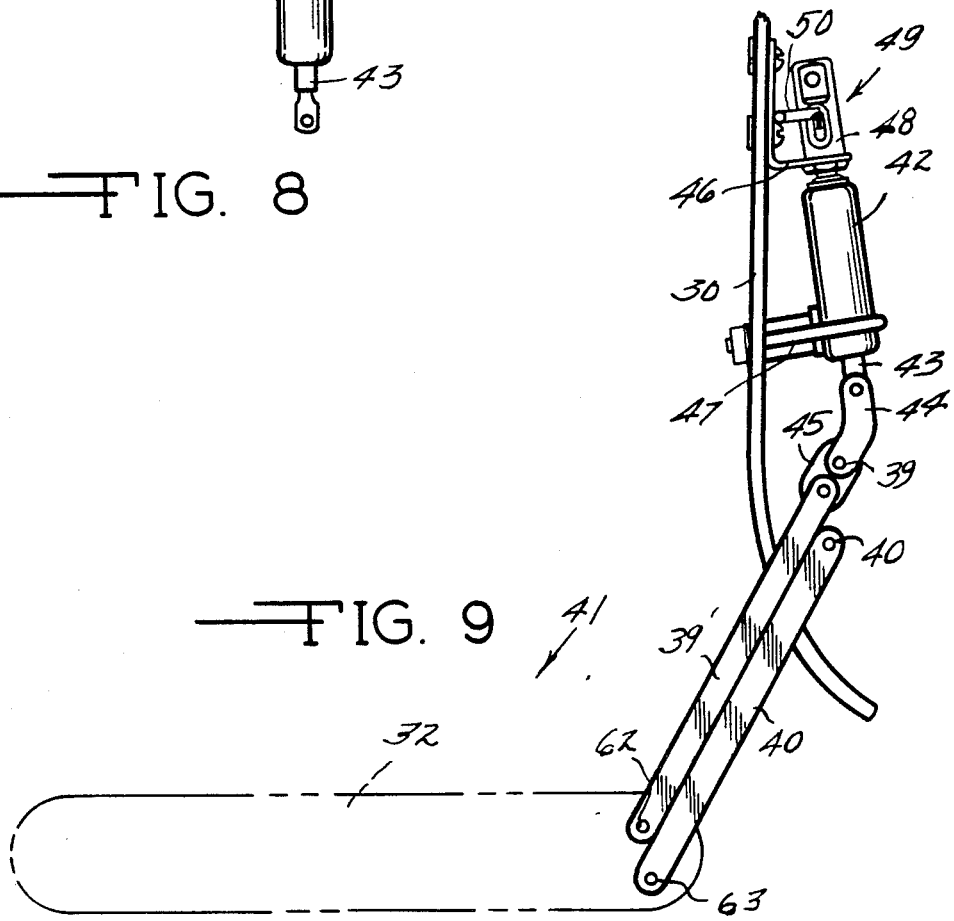

FIG. 9 is a side elevation view of a back plate with connected actuator structure in the fully depressed position.

GENERAL DESCRIPTION

In general an arm height adjustment is provided which comprises a chair back and a pair of height control arms which extend to articulated connection with an arm rest portion or extension which is usually padded. The arms of the chair are thus made up of the arm rests and the connected height control elements. Pantographic means including a remotely controlled source of stored energy is secured to the back of the chair and this selectively and eccentrically locks the arms by their connection to the arm height control bars in a manner assuming substantially parallel positioning of the arm rests and height control elements in all adjusted positions.

The chair is preferably structured to incude a chair base which may be of the swivel type in which the seat is rotatable in a relatively horizontal position atop the swivel of the base. The seat is secured to a seat saddle and the seat saddle is pivotal on a seat frame. The seat frame is journalled on the vertical shaft or post of the chair base. Adjustable torsion means extends rearwardly to connection of the seat back support to the frame and the seat back support is adjustably positionable in respect to the frame.

The seat back support is adjustably connected to the seat back. The seat back is configured to accomodate the back contours of a user and supports the arm elements of the present chair structure. The actuating mechanism is supported by the actuator base and the base also supports journalling for the height control bars for the arm rests.

SPECIFIC DESCRIPTION

Referring to the drawings and with first particularity to the FIG. 1 thereof, the preferred embodiment of a chair 11 in accord with the present invention is shown. A pedestal 12 arises from a fixed or movable support or base (not shown) and one of a variety of devices well known in the art. The pedestal 12 may be adjustable as to height by mechanical, hydraulic, or pneumatic means and supports a chair seat frame 13. It is preferred that the frame 13 be seated on the pedestal 12 in a manner to swivel about the pedestal 12. The seat frame 13 supports a seat saddle 14 and the saddle 14 is pivotally connected to the seat frame 13 at the relatively horizontal pivot 15 and ahead of and transverse of the swivel axis of the pedestal 12. The seat 16 is then secured to the saddle 14 and rocks or tilts upon the horizontal pivot 15 with the saddle 14. An adjustable compression spring member 17 is supported by the frame 13 and provides a selectively variable cushion in support of the forward portion of the seat 16. A dust boot 18 jackets the spring 17 and spring compressor components of headed bolt 19 and adjustment wing-nut or knob 20. The seat saddle 14 extends rearwardly to an adjustable connection 21 with the seat back support 22. The connection 21 comprises a headed bolt 23 extending through a slot 26 in the back support element 22 and through a saddle supported cross member 24 to the threaded knob 25 by means of which the seat back support element 22 can be moved respectively, forwardly or back (relative to the seat 16) to the extent of the slotted portion 26. In this manner ergonometric adjustment of the support 22 to the physiognometry of the back of a particular user is achievable. Torsional means 27 extending from the frame 13 is adjustable by means of the hand manipulated screw 28 acting between torsional means 27 and the saddle 14 to provide a resilient control linkage as between the back support 22 and the connection of seat 16 to saddle 14.

The seat back support 22 rises from the adjustable connection 21 to support the chair back plate 30. The chair back plate 30 is contoured to serve the shoulders and back of a user and the chair back 31 is regarded as the combination of back plate 30 and back support 22. To the back 31 is attached a mechanism for adjusting the height of the chair arms 32. Back plate 30 and arms 32 may be padded or not as desired by styling or esthetic considerations. Preferably, the back plate 30 supports top and bottom resilient pads 33 (foam resilient material as a foam rubber ring-pad) and pad 34, respectively, and these cushion the extremes of travel of the back plate 30 against the back support 22. The back plate 30 includes a bracket 35 which is pivotally connected to the back support 22 at pivot point 36. The pivot 36 allows rocking of the back plate 30 in respect to the back support 22 since the pivot 36 extends also through the mounting ears 37 of the sleeve 38 which is secured to the top of the back support 22. A pair of arm support bars 39 and 40 are journalled in the bracket 35 and effectively extend as indicated in 39' and 40' in parallel spaced relationship to pivotal pantographic connection within the arm rests 32 whereby upon rotation of one of the journalled bars 39 and 40 both move in parallelogram or pantographic unison fashion in parallel manner and the arm rest 32 moves up and down through a range limited by closing contact of the bars 39 and 40 against each other and in parallel or selected angular parallelity referenced for example to the horizontality of the seat 16 and as shown in phantom line in the FIG. 1. The arms 41 comprising the bars 39, 40 and the side extensions thereof 39' and 40' together with the arm rest portions 32 will be seen to be adjustable from horizontality of the arm rest 32 by changing the position of the pivotal end connections of one of the bars 39' or 40'. To adjust the raising or lowering of the arms 41 rotational movement of one of the bars 39 or 40 in their fixed journals will change the height or elevation up and down. As will be seen this is achieved by providing a source of power in the back 31 of the chair 11 and operatively connecting the source of power (for example a power cylinder) to one of the bars 39 or 40 by an eccentric lever or the like.

Figure 2:
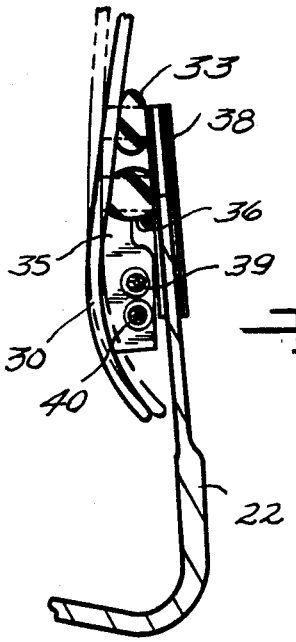
FIG. 2 is a partial elevation view of a slightly modified back and back support portion of the structure of FIG. 1.

In FIG. 2 the function of the ring-cushion 33 is best illuminated as providing a resilient cushion to tilting of the back 30 on the pivot 36 and the phantom lines suggesting the extent of the cushion supported movement and control over lumbar contact extension when the user leans back to contact with the upper portion of the chair back plate 30.

This cushioning assures a controlled following of the upper back by the seat back plate 30 and an adjustment to the back contour of the user as the cushions 33 and 34 gently function to subtle repositioning between the back plate 30 and the back support element 22 at the sleeve 38 and against the back support 22.

Figure 3:
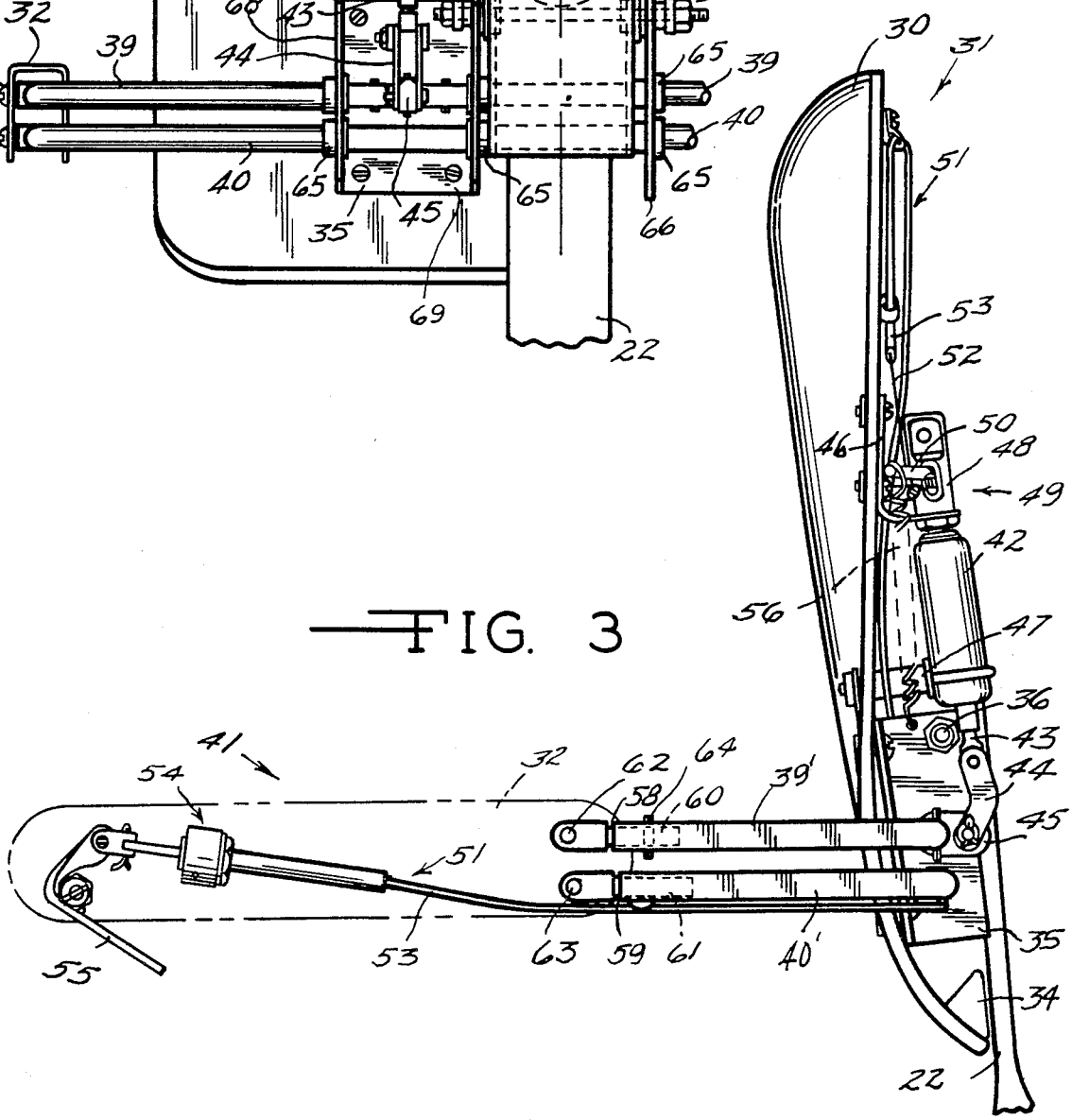
FIG. 3 is a side elevation view of one of the arm rests as operably supported by the parallel arm support elements and pivotally connected to an eccentric drive structure supported by the back of the chair which also shows the trigger support of the Bowden wire activating means extending to the power cylinder.

With reference to FIG. 3 the arm rests 32 extending toward the forward (seat front) part of the chair 11 flank the seat 16 on both sides of an occupant as shown in FIG. 1 and the cylinder 42 which is the source of locking energy is best illustrated secured to the chair back plate 30 and the piston thereof is operably connected by means of a link 44 which link 44 is in turn connected to eccentric arm 45. The arm 45 is connected to and rotates one of the pantographic and parallel arm bars 39 and 40 shown as bar 39. The cylinder support brackets 46 and 47 provide steady and firm aligning mounts for the cylinder 42. The uppermost bracket 46 also supports the valve head 48 which houses the valve actuating structure 49 for the cylinder 42 and supports the actuating lever 50. The lever 50 is operably connected to the Bowden wire structure 51 at the movable core piece 52 which is controlled in its path of reciprocal movement by the sheath 53. The sheath 53 is fixed in its path allowing some flexure as it is trained to one of the arm rests 32 and is there supported in an actuator bracket 54. The actuator bracket 54 for the Bowden wire 51 remote control is preferably located convenient to the hand of the user of chair 11 as shown in the arm rest 32 and a trigger 55 is pivotally connected to operate the Bowden wire 51 core piece 52 for selected actuation of the remotely positioned valve actuator structure at the cylinder 42. A spring 56 is connected to the actuating lever 50 extending from the valve actuator structure 49 to provide a valve closing bias. In this position the cylinder locks the piston 43 against movement and secures the existing position of the bars 39 and 40 and the selected attitude of the arm rest 32. The counterpoise force of the piston in the cylinder 42 requires very little manual energy from the seat occupant to move the arm rests 32 up or down, selectively. When the trigger 55 is depressed the spring bias applied by spring 56 is overcome and the lever 50 of the actuator structure valve 49 then opens the internal valve of the cylinder 42 so that very slight urging by the occupant can then move the arm rests 32 and connecting arm bars 39 and 40 to any selected position and release of the same trigger 55 returns the valve of the cylinder 42 to the closed or locked position by action of the spring 56 and the arm rests 32 are selectively positioned within the limits of movement of the bars 39 and 40. The Bowden wire sheath 53 is conveniently routed by the position of fasteners 57. In the FIG. 3 the back support 22 is seen adjacent to the bracket 35 which journals and supports the arms 39 and 40 for parallel spaced apart movement. The ends 58 and 59 of the bars 39 and 40, respectively, are provided with threaded clevis fittings 60 and 61, respectively, which extend to spaced apart pivotal connection at pivots 62 and 63, respectively, to the arm rests 32. The fitting 60 is fixed and non-extendable by means of the lock pin 64 but the fitting 61 is threadably or adjustably extendable in relation to the bar 40. This permits angular adjustment of the arm rest 32 so that all movement of the chair arms 32 are substantially parallel in whatever reference plane is selected as the arms 32 are moved up and down, as illustrated. The arm rests 32 are generally parallel to the seat plane to all selected heights. This provides an infinite selection of positions between the limits of travel of the pantographic system described and a wide infinite selection of planar orientation as provided by adjustment at the fitting 61 at pivot 63.

Figure 4:
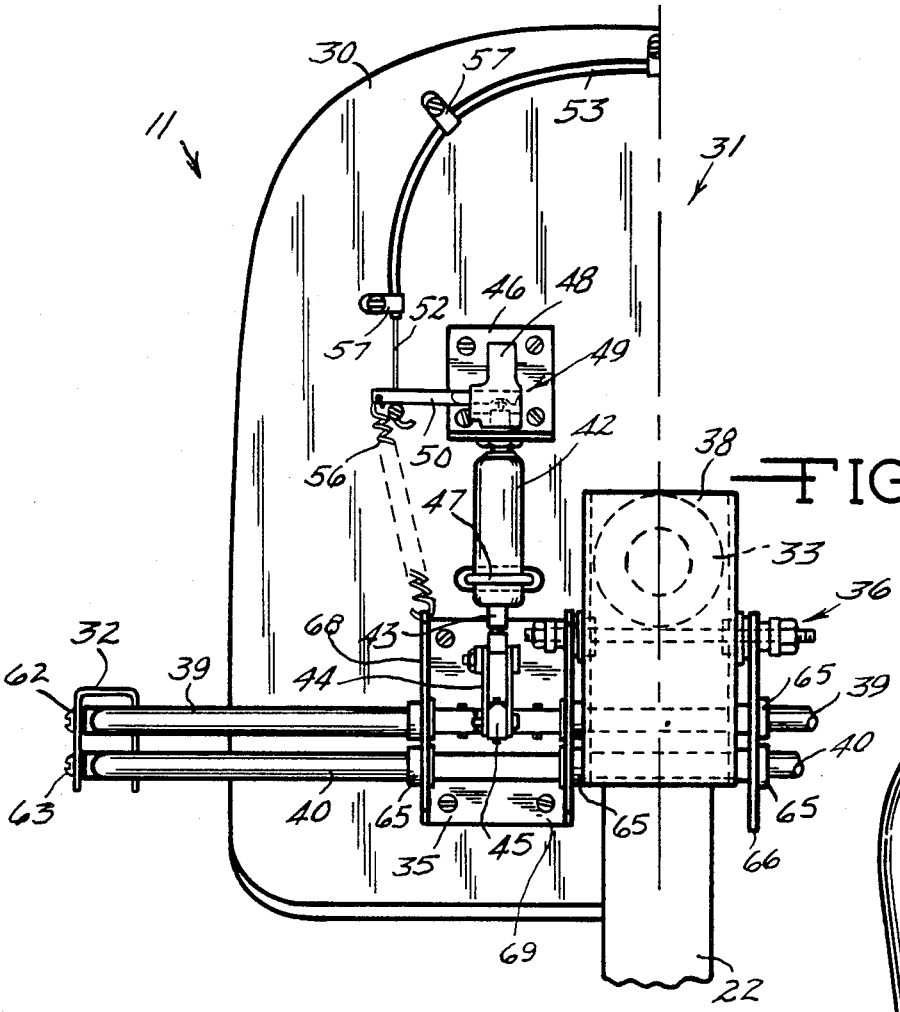
FIG. 4 is a partial rear elevation view of one side of the chair back and chair back support and indicating cylinder drive support and the control bars of FIG. 3.

The FIG. 4 is useful in appreciating the preferred arrangement of the elements contained in the chair back 31 and in respect to the chair back support 22 and back plate 30. The sleeve element 38 is adjustably on the chair back support 22 and in phantom line the ring pad cushion 33 of resilient foam material is best understood and the bracket pivot 36 connecting chair back support 22 to the chair back plate 30 at the bracket 35 can be seen. The bracket 35 is preferably repeated on the side of the chair 11 without the cylinder 42 in support of the bearings or bushings 65 in parallel journal support of the arm bars 39 and 40 in bushings 65. Stops (not shown) prevent axial movement of the bars 39 and 40 in bushings 65. The brackets 35 are channel-like elements having flanges 66 rising from the center web 67 which is secured to the back plate 30 at the rear of the chair 11. The bracket 46 is an L shaped tabular element one leg of which is secured to the back plate 30 at the rear of the chair 11 and it supports the valve head 48 which houses the actuator valve structure 49 and provides a mounting connection for cylinder 42. The lower bracket 47 provides lower encircling support for the cylinder 42 and is fastened through the back plate 30. The brackets 46 and 47 align the piston 43 of the cylinder 42 in operable connection to the eccentric 45 by means of the pivot link 44. The routing of the Bowden wire structure 51 as it controls the actuator valve structure 49 from connection beneath one or the other of the chair flank arm rests 32 is also clarified. As will be appreciated the back support 22 is adjustably connected to the chair 11 as described in FIG. 1.

Figure 5:
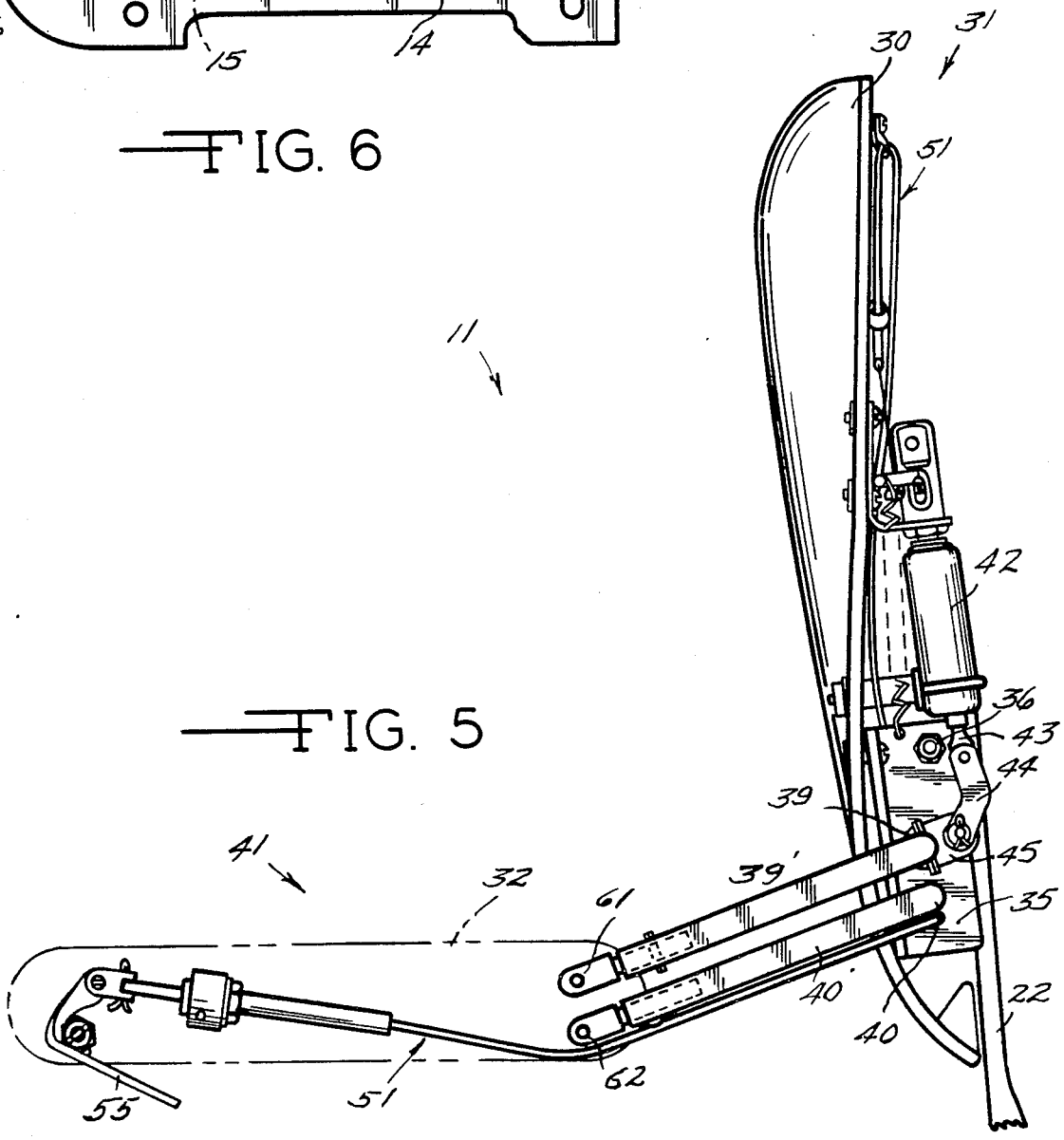
FIG. 5 is an elevation view of the arm and back of a chair in accordance with the present invention taken from the side as seen in FIG. 3 and indicating the lowering of the arm rest by the retraction of the piston in the power cylinder and the movement of the height support bars.

FIG. 5 is substantially as in FIG. 3 but indicating the contraction of the piston 43 attending adjustment of the height of the rests 32 and connecting arms bars 39 and 40 upon depressing the trigger 55 and freeing the locked condition of the cylinder 42. The arm rest 32 remains parallel to its set horizontal position seen in FIG. 2 but is depressed from that position to the position shown in FIG. 5.

The cylinder 42 is a source of power for the lock-up of the selected pantographic chair position. When the valve in cylinder 42 is closed no movement is possible in the parallelogram arm support. When the valve in cylinder 42 is opened, then, against a slight counter poise of thrust the pantographic linkage is easily movable to a position selected and directed by the user. Releasing the trigger 55 locks the linkage by prevention of the cylinder from function and no movement is possible until the valve in cylinder 42 is again opened by occupant depressing of the trigger 55 moving the valve operation lever 50.

In the preferred embodiment the cylinder 42 is a gas cylinder and the rated pressure is about 250 Newtons. This force is sufficient to lock the arm rests 32 and at the same time permits the user to easily push the arm rests 32 and connected linkage 39 and 40 down or up when the trigger 55 is depressed and then hold the set position when the trigger 55 is released. The travel of the armrests 32 is limited by two parameters, the travel of the piston rod 43 in the gas cylinder 42 and the space between arm support bars 39 and 40. In the preferred embodiment with 1 inch of piston travel and $\frac{3}{8}$ inch spacing between the bars 39 and 40 the optimum up and down travel is about $10\frac{1}{2}$ inches and very capable of serving most any of the extremes of use. The indicated parameters are useful to design greater or lesser movement.

In FIG. 6 the saddle 14 frame 13 and back support 22 of chair seat 16 is best understood and the seat adjustments are visualized. The relatively horizontal pivot 15 through frame 13 and saddle 14 permits relative tilting on the axis of the pivot 15 and allowing the seat 16 which is fastened to the saddle 14 to both tilt and to rotate. As previously indicated in reference to FIG. 1 the frame 13 is adapted to mount on the pedestal 12 and the frame 13 rotates with the seat 16 on the pedestal 12. The pivot 15 is located in front (in respect to the "front" of chair 11) of the connection of frame 13 to pedestal 12.

The saddle 14 includes a frontal flange 66 and the bolt 19 extends through the flange 68 as shown and through the spring 17 and through a floor plate portion 69 of the frame 13. The wing nut on the threaded extension of the bolt 19 bears against the frame floor plate 69 to selectively compress the spring 17 between the frontal flange 68 of the saddle 14 and the floor plate 69. As noted in reference to FIG. 1 this adjusts the tilt angle of the seat 16 as desired on the pivot 15. While also allowing the spring to compress further when down and forward key pressure is applied. At the rear of the frame 13 the back support 22 is adjustably extendable in respect to the frame 13 allowing the back support 22 to be moved toward or away from the saddle 14 and frame 13 by use of the bolt 23 through the slot 26 at connection 21 for releasing and locking. The knob 25 accommodates the release in the slotted portion 26.

Torsion spring means 27 allows the stiffness of the back support 22 to be adjusted relative to the frame 13 as shown.

OPERATION

In operation the chair 11 of the present invention permits a wide range of height adjustment of the arms rests through a broad range of parallel up and down positions and by means of the described pantographic linkage. In addition, the preferred embodiment is adjustable at the terminal end of the arm bars 39 and 40 so that the angle given to the parallelity in the arm rests 32 can be selected. The source of energy to lock the system in selected position is self contained and regenerated in the cylinder and is operably linked to the pantographic members. Operation of the power source is remotely accomplished by the chair occupant to lock or unlock the piston. By locating the mechanism in the back of the chair 11, as supported by the back support or post 22, esthetic advantages are obtained and the back plate 30 together with the arm rests 32 provide ergonometric advantages obvious to those in the business of designing chairs for both working and relaxation environments. The back also provides cushioning buttresses between back plate and back support.

As for the seat portion 16 of the chair 11, the described mounting of the seat 16 allows a forward tilting in relief of undue and fatiguing pressures under the thigh portions of the legs of one seated in the chair 11 and the threshold of tilt relief is adjustable. The seat to back distances are adjustable as is the torsional adjustment of back stiffness.

The FIG. 7 exemplifies the upper extreme of movement of the arms 41 limited by the eccentric relationship of cylinder 42 to bar 39 and by contact between the bars 39 and 40. FIG. 9 shows the lower limit of height elevation adjustment as previously described.

FIG. 8 provides a more detailed presentation of the Bowden wire structure 51 as connected to operate the lever 50 to control by remote means the valve function of the cylinder 42 as previously described.

While the description has concentrated on the executive and office uses of a chair 11 it is appreciated that the arm adjustment capability adapts the usage to any chair and that the articulated arm bars may be supported by other structural members in the back portion of any chair without departure from the intended spirit of the invention.

It is also appreciated that the arm rest portions of the arm structure may be padded or shrouded as by upholstering or other decorative facade. Similarly the back may be padded as desired.

While the arm structures have been described by reference to a single side of the chair it is to be understood that the arm rests 32 are 2 in number, one on either side of one seated in the chair 11 and that the arm rests are both connected to the described actuating structures and firmly journalled to support normal stresses applied to chair arms and arm rests.

Having thus described my invention and the preferred embodiment thereof others skilled in the art will appreciate changes, improvements and modifications within the skill of the art and such changes, improvements and modifications are intended to be included herein limited only by the scope of my appended claims.

I claim:

1. In a chair the arm height adjustment combination comprising:

a chair back;

a pair of arms extending from said back of said chair;

arm rests at the ends of said pair of arms;

operable means including a remotely controlled source of stored energy secured to said back and selectively and eccentrically connected to at least one of said arms and unlocking said arms of said extending arm rests for pantographic height adjustment thereof.

2. A chair having adjustable arms and comprising:

a supported chair back;

a pair of chair arms;

a pair of parallel spaced apart control elements in pivotal support at one of their ends to each of said chair arms;

a pair of pivotally journalled parallel torque transmitting bars operably supported by chair back and pivotally and operably secured to the other of said ends of said control elements;

a remotely operable source of energy operably secured to said chair back and selectively and eccentrically thrustable against one of said torque transmitting bars whereby said arms are selectively raised and lowered in substantial parallelity.

3. A new and improved adjustable chair having adjustable height chair arms comprising:

a chair having a seat and a back;

a vertical support pivot for said chair and supporting said seat;

a back support member connected to said seat and in support of said back;

a pair of chair arms each including an arm rest portion and;

a pair of spaced apart parallel torque transmitting adjacent height control elements journalled to said back in parallel relation to each other and pivotally connected to each of said arm rests at the ends of said control elements;

a crank arm extending in an eccentric direction from one of said torque transmitting bars; and a remotely actuated source of stored energy connected to said back and to said crank arm for selectively rotating one of said height control elements and imparting pantographic movement in said height control elements to selectively raise and lower said arms.

4. In the chair of claim 3 wherein said seat includes a front and back with a tilting pivot permitting selection of pitch angle from the front to back of said seat and tilting under a selected adjustable resilient bias when user weight is transferred forwardly, said bias located between said front of said seat and said tilting pivot for said seat.

5. In the chair of claim 4 wherein said seat is operably connected to said back support at a horizontal pivot and under selected resilient torsional force, and means adjustably and lockably retracting and extending said chair back support in respect to said seat.

6. In the chairs of claim 5 wherein said back support is tiltably connected to said back and a cushion located between said back and said back support provides a limited resilient travel.

* * * * *